US005857949A

United States Patent [19]

Tebbe et al.

[11] Patent Number: 5,857,949

[45] Date of Patent: Jan. 12, 1999

[54] METHOD FOR EXERCISING ABDOMINAL MUSCLES

[76] Inventors: James C. Tebbe, 6001 Wilmer Rd.; Jennifer Rose Kern, 7560 Cheviot Rd., #303, both of Cincinnati, Ohio 45247; Cynthia Ann Nielsen, 9198 Sagemeadow Dr., Cincinnati, Ohio 45251; James R. Tebbe, 9014 Bace Dr., Houston, Tex. 77055

[21] Appl. No.: 709,870

[22] Filed: Sep. 10, 1996

[51] Int. Cl.[6] ..... A63B 23/02

[52] U.S. Cl. ..... 482/140; 482/131; 482/139

[58] Field of Search ..... 482/10, 91, 92, 482/95, 96, 131, 140, 139, 148, 904, 908; D21/191, 193

[56] References Cited

U.S. PATENT DOCUMENTS

| | | | |
|---|---|---|---|
| 1,556,496 | 10/1925 | Davis | 482/96 |
| 1,899,255 | 2/1933 | Bell | 482/96 |
| 2,189,145 | 2/1940 | Lee | 482/96 |
| 2,716,027 | 2/1955 | Gehri . | |
| 3,442,513 | 5/1969 | Fisher | 482/139 |
| 3,540,439 | 11/1970 | Gaylord, Jr. | 602/32 |
| 3,851,874 | 12/1974 | Wilkin | 482/129 |
| 3,858,874 | 1/1975 | Weider . | |
| 4,060,240 | 11/1977 | Dunston . | |
| 4,079,933 | 3/1978 | Everroad . | |
| 4,205,839 | 6/1980 | Best . | |
| 4,456,249 | 6/1984 | Calabrese . | |
| 4,602,619 | 7/1986 | Wolf et al. | 606/241 |
| 4,819,936 | 4/1989 | Muller | 482/131 |
| 5,024,214 | 6/1991 | Hayes | 482/95 |
| 5,122,107 | 6/1992 | Gardner | 482/140 |
| 5,267,931 | 12/1993 | Faetini | 482/140 |

FOREIGN PATENT DOCUMENTS

| | | |
|---|---|---|
| 22932 | 11/1901 | United Kingdom . |

*Primary Examiner*—Jeanne M. Clark
*Attorney, Agent, or Firm*—Dinsmore & Shohl LLP

[57] ABSTRACT

An apparatus for exercising abdominal muscles comprises a load cable which is received by a pulley. The pulley is connected to a structure through a connector, and a single handle is connected to the first end of the load cable. A neck collar is connected to the second end of the load cable. In the method of exercising, the user lays on a surface and contracts the abdominal muscles to raise the torso no more than halfway to the normal position. Concurrently, the user pulls the handle such that a load is communicated between the handle and the neck collar to assist the abdominal muscles in raising the torso.

3 Claims, 2 Drawing Sheets

METHOD FOR EXERCISING ABDOMINAL MUSCLES

TECHNICAL FIELD

The present invention relates generally to exercise apparatus and more specifically to such apparatus for performing abdominal exercises.

BACKGROUND

Physical fitness continues to be extremely important in our society. At the same time, however, many persons find it increasingly difficult to go to a gym, and consequently, home exercise equipment is often desirable. In addition, persons who travel may find it difficult to exercise when away from home. Thus, portability and compactability are increasingly desired qualities in exercise equipment.

Among fitness activities, abdominal exercises are popular. Traditionally, abdominal exercises are achieved through sit-ups, which involve a person laying on a surface and repeatedly raising the upper torso to an upright sitting position. However, traditional style sit-ups have several shortcomings. For instance, a high number of repetitions of exercises involving light weight are considered to have unique and beneficial results over a low number of repetitions of exercises involving heavy weight. However, traditional sit-ups do not permit variability in the weight, so the number of repetitions of the exercise is limited by a person's abdominal strength. As a result, some people simply lack the strength needed to perform a desired number of repetitions. Additionally, shallow sit-ups, also known as partial sit-ups, can provide superior abdominal exercise while reducing stresses through the spine. However, the repetition problem in traditional sit-ups is amplified with shallow sit-ups since the shallow portion of a sit-up is the most difficult part of the exercise (i.e. requires the most strength).

SUMMARY OF THE INVENTION

Accordingly, an object of this invention is to provide an exercise apparatus, and more particularly to provide a method and apparatus for exercising the abdominal muscles.

One embodiment of the present invention is an apparatus comprising a load cable capable of carrying a load and having first and second ends. A means for changing the direction of a load carried by the load cable, such as a pulley, is adapted for receiving the load cable. The apparatus also includes a means for connecting the direction changing means to a structure, such as a door knob. A single handle is adapted to communicate loads between the first end of the load cable and a user's hands. Additionally, the apparatus comprises a means for supporting a user's upper body, wherein the supporting means is adapted to communicate loads between the second end of the load cable and the user's upper body.

Other objects, advantages, features, and aspects of the present invention will become apparent to those skilled in the art from the following description of preferred embodiments, which is simply by way of illustration one of the best modes contemplated for carrying out the invention. As will be realized, the invention is capable of other different obvious aspects without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several embodiments of the present invention and together with their description serve to explain the principles of the invention. In the drawings.

Reference will now be made to the detailed description of the invention, an example of which is illustrated in the accompanying drawings, wherein like numerals indicate the same elements throughout the views.

DETAILED DESCRIPTION

Figure 1:
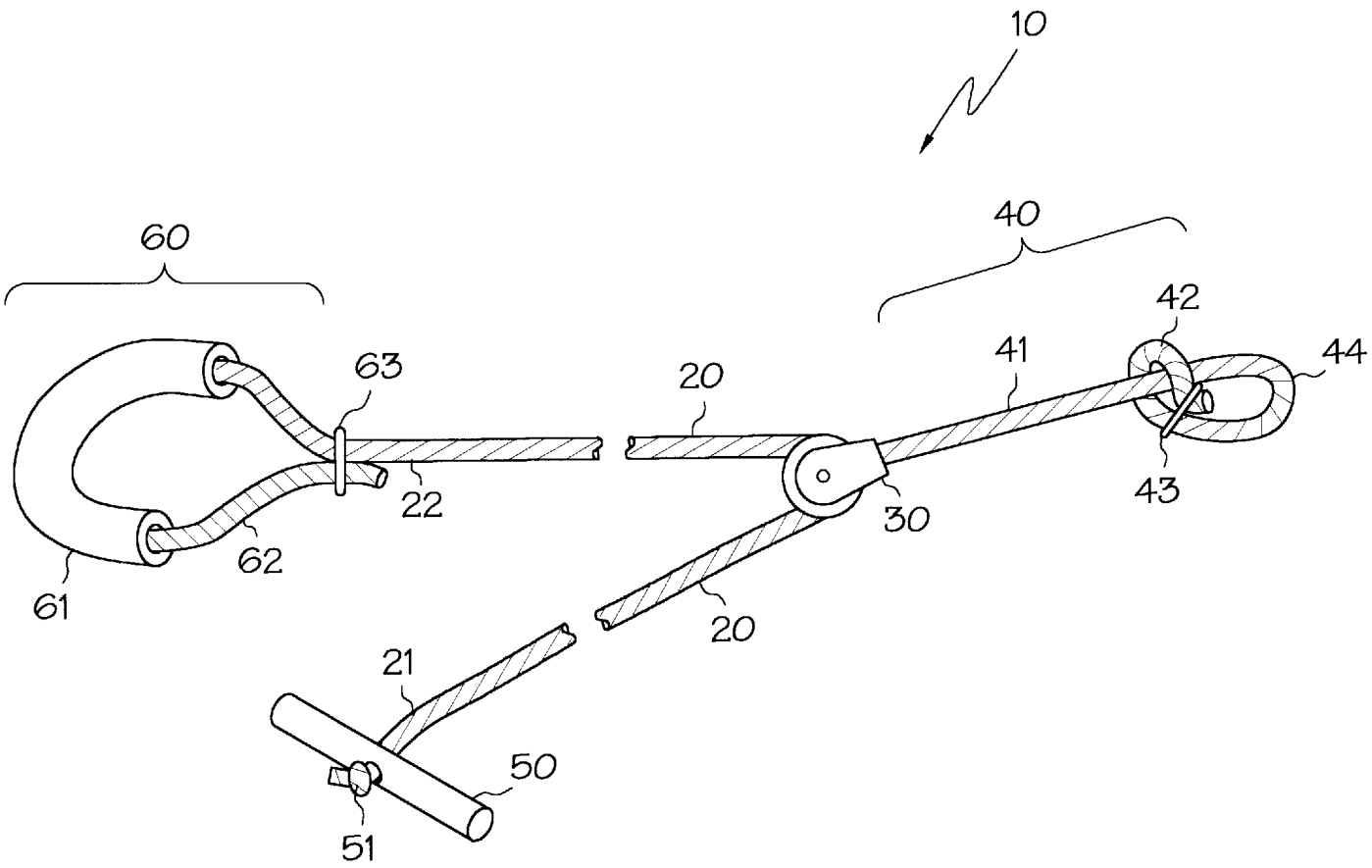
FIG. 1 depicts one embodiment of an exerciser of the invention.
Figure 2:
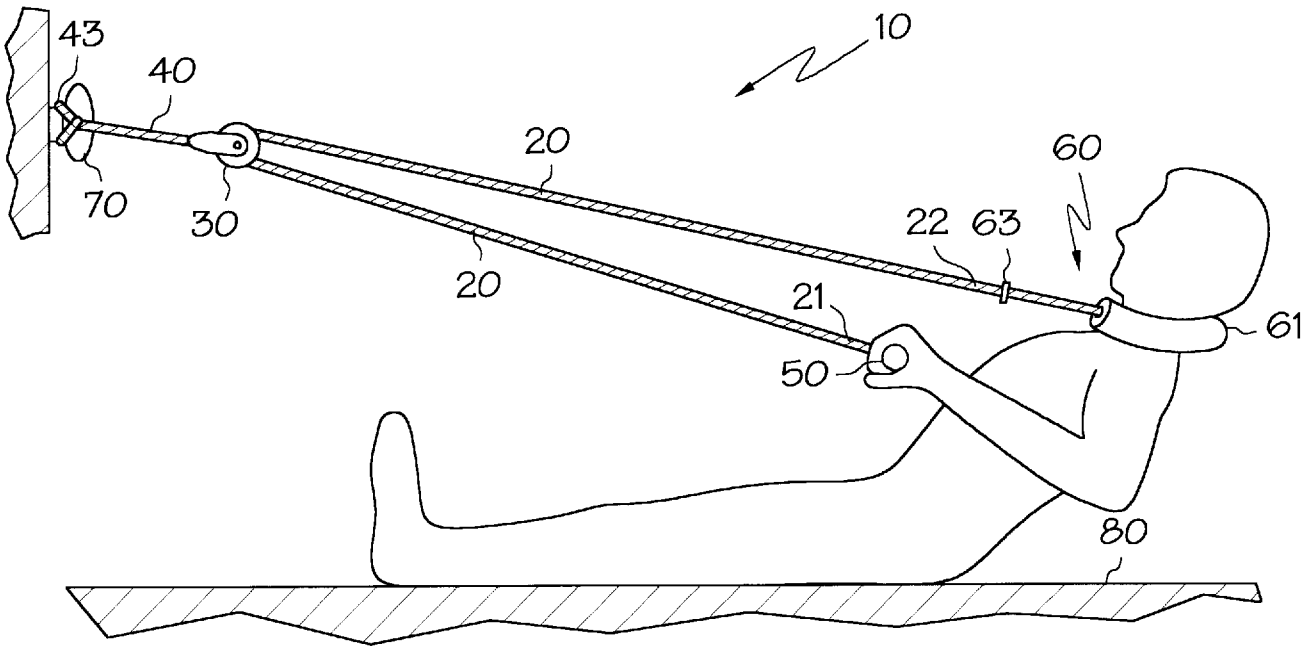
FIG. 2 depicts the exerciser in FIG. 1 being used by a person to exercise abdominal muscles.

One embodiment of the present invention is illustrated in the figures. FIG. 1 depicts a detailed view of an exercise apparatus 10, and FIG. 2 depicts the exercise apparatus 10 in use by a person. The exercise apparatus 10 includes a load cable 20 extending from a first end 21 to a second end 22, which cable is adapted to carry loads. The load cable 20 may comprise a variety of suitable materials, including a rope, cord, strap, chain, wire, or the like. In a preferred embodiment, the load cable 20 is a nylon rope. A direction changing means receives the load cable 20 and provides a means for changing the direction of the load carried by the cable 20. While shown here as a wheel-type pulley 30, the direction changing means could include a variety of other suitable structures, such as a ring through which the cable 20 passes or a metal wear surface. Alternatively, a plurality of pulleys in the form of a pulley block could be used to alter the relative load and/or stroke of the first end 21 of the cable as compared to the second end 22 of the cable.

A connector 40 provides a means for connecting the pulley 30 to a structure 70. As shown in FIG. 2, the structure 70 is a door knob, however, a variety of other structures could be used, including a hook or other member attached to a wall or door, a framed structure such as a weight lifting apparatus, a bed post or other stationary furniture, or the like. In this embodiment, the connector 40 includes a mounting cable 41 attached to and extending from the pulley 30 towards the structure 70. The mounting cable 41 can be formed from one or more of the same materials suitable for the load cable 20, but does not necessarily have to be the same material as the load cable 20. In a preferred embodiment, the mounting cable 41 is a nylon rope.

In the embodiment of FIG. 1, a fixed loop 42 is formed in one end of the mounting cable 41 using a fastening mechanism, such as a metal crimp 43, but a knot or other similar means could be used. The remainder of the mounting cable 41 is then passed through the fixed loop 43 to form an adjustable loop 44. The adjustable loop 44 is designed to fasten the mounting cable 41 to the structure 70, and has the advantage of tightening around the structure 70 when a tensile load is passed through the mounting cable 41. In an alternative embodiment, the connector 40 could attach to the structure 70 using a bolt, hook or ring, which could be directly connected to the pulley 30, the mounting cable 41, or the structure 70, or could compromise a rigid member extending between the structure 70 and the pulley 30.

The exercise apparatus 10 also includes a single handle 50 connected to the first end 21 of the load cable 20. The handle 50 is adapted to communicate loads between the first end 21 of the load cable 20 and the user's hands. Preferably, the handle 50 is a bar for gripping with one or both hands and is made from wood, metal, plastic, or other structural materials, however, other suitable handles may comprise curved or bent bars, T-shaped members, triangular members, and the like. One way of attaching the handle 50 to the load cable 20 is to pass the load cable 20 through a hole in the approximate middle of the handle 50 and tie a knot 51 such that the knot 51 cannot pass back through the hole. A variety of other fastening arrangements will be apparent and may be employed for attaching load cable 20 to the handle 50.

The exercise apparatus 10 further includes a support which provides a means for supporting a user's upper body (i.e. a portion of the user's body above the waist) and for communicating loads between the second end 22 of the load cable 20 and the supported upper body. Preferably, the support comprises a neck collar 60 capable of supporting the back of the user's neck. The neck collar 60 preferably includes a flexible loop 62 fastened to the second end 22 of the load cable 20. In the embodiment of FIG. 1, the loop 62 is an extension of the load cable 20 and is formed using a fastening mechanism, such as a crimp 63. An alternative fastening mechanism could comprise an adjustable fastening member for changing the length of the loop 62 and/or the length of the load cable 20, to facilitate a custom fit of the apparatus 10 for a variety of different sized people. If an adjustable fastening member is used, the member should lock such that the loop 62 will remain a fixed length when a load is transmitted from the neck collar 60 to the load cable 20 to avoid tightening the loop 62 around the user's neck.

In the embodiment of FIG. 1, a portion of the loop 62 is surrounded by a foam cushion 61 at the point of contact between the loop 62 and the user's neck to provide a comfortable interface. Alternatively, a flexible strap may form a portion or all of the loop 62 to provide a comfortable interface. In another embodiment, the support may include a shoulder harness. In still a further embodiment, the support may comprise a plate or other member to support the user's head, shoulders, and/or back. Such a plate or other member is preferably substantially rigid and contoured to interface with a user, and may additionally be padded for comfortable contact with the user.

FIG. 2 demonstrates one mode of operating the exercise apparatus of FIG. 1. The exercise apparatus 10 is used by first attaching the connector 40 to a structure 70. Next, the support 60 is attached to the user's upper body and the handle 50 is grasped, preferably with both hands. While lying face upwards on a surface 80 (e.g. a floor, bed, or exercise platform, optionally angled relative to the floor), the user at least partially extends his/her arms such that the load cable 20 is at least partially taut between the handle 50 and the support 60. The user then contracts his/her abdominal muscles to raise the torso of the person no more than halfway to the normal position relative to the surface 80, as depicted in FIG. 2. This partially raised position is a shallow sit-up. Preferably, the shoulders of the user are raised from about 1 inch to about 12 inches above the surface 80.

Concurrently while contracting the abdominal muscles, the user pulls the handle 50 using his/her arms such that a load is communicated between the handle 50 and the support 60 to assist in the raising of the torso. Preferably, this raised position is maintained for about 1 second, however, longer or shorter periods of time can be effective. The user lowers the torso back toward the lying position. This lowering step may either return the torso fully to the lying position on the surface 80, or alternatively may return the torso only partially to the lying position such that the user's back does not fully contact the surface 80. A series of the raising and lowering steps may be repeated as desired.

The above-described procedure facilitates a high number of repetitions of the shallow sit-up, and thus provides an optimized exercise for the abdominal muscles. Furthermore, the user can regulate the degree of muscular effort by adjusting the load transmitted by the arms. Also, this embodiment provides the benefit of automatically limiting the possible range of motion thereby promoting shallow sit-ups. This automation is achieved because the gripping of the handle 50 with both hands limits the stroke of the handle 50 from the fully extended position of the arms to a position adjacent the chest, which thereby limits the distance of the user's sit-up. Furthermore, this apparatus 10 has the benefit of portability and compactability since all of the components can be rolled or otherwise packaged together and easily transported. Beyond the aforementioned advantages of this invention, this apparatus 10 also provides the motivational advantage of encouraging users to exercise since using the apparatus 10 can be considered fun, which will tend to motivate users to use the apparatus 10 regularly.

The foregoing description of the preferred embodiment of the invention has been presented for purposes of illustration and description. It is not intended to be exhaustive nor to limit the invention to the precise form disclosed. Many alternatives, modifications and variations within the scope of the invention will be apparent to those skilled in the art in light of the above teaching. Accordingly, this invention is intended to embrace all such alternatives, modifications and variations that fall within the spirit and broad scope of the appended claims and their equivalents.

The invention claimed is:

1. A method for exercising abdominal muscles, comprising the steps of:

(a) placing a neck collar around the neck of a user, wherein the neck collar is the only upper body support and the neck collar is connected to a first end of a load cable being received by a pulley;

(b) grasping with both hands of a user a single handle connected to a second end of the load cable;

(c) lying on a surface and facing upwards such that the arms of a user are at least partially extended and the load cable is at least partially taut between the handle and the neck collar;

(d) contracting the abdominal muscles of a user to raise the torso of a user no more than halfway to the normal position relative to the surface;

(e) concurrently with step (d), pulling the handle such that a load is communicated between the handle and the neck collar to assist the abdominal muscles in raising the torso;

(f) lowering the torso of a user back toward the lying position; and (g) repeating steps (d) through (f) as a user desires.

2. A method as recited in claim 1, wherein during the step of contracting the shoulders of a user are raised from about 1 and about 12 inches above the surface.

3. A method as recited in claim 1, wherein a user pauses between steps (e) and (f) for about 1 second.

* * * * *

UNITED STATES PATENT AND TRADEMARK OFFICE

CERTIFICATE OF CORRECTION

PATENT NO. : 5,857,949
DATED : January 12, 1999
INVENTOR(S) : James C. Tebbe, Jennifer R. Kern, Cynthia A. Nielsen, James R. Tebbe It is certified that error appears in the above-identified patent and that said Letters Patent is hereby corrected as shown below:

Claim 2, line 2, change [contracting] to -- contracting, --.

Signed and Sealed this

Eleventh Day of May, 1999

*Attest:*

Q. TODD DICKINSON

*Attesting Officer*

*Acting Commissioner of Patents and Trademarks*